US007856991B2

(12) United States Patent
Badertscher

(10) Patent No.: US 7,856,991 B2
(45) Date of Patent: Dec. 28, 2010

(54) FILTER CIGARETTE

(75) Inventor: Thomas Badertscher, Cernier (CH)

(73) Assignee: Philip Morris USA Inc., Richmond, VA (US)

( * ) Notice: Subject to any disclaimer, the term of this patent is extended or adjusted under 35 U.S.C. 154(b) by 553 days.

(21) Appl. No.: 11/883,355

(22) PCT Filed: Jan. 27, 2006

(86) PCT No.: PCT/EP2006/050486

§ 371 (c)(1),
(2), (4) Date: Aug. 28, 2007

(87) PCT Pub. No.: WO2006/082161

PCT Pub. Date: Aug. 10, 2006

(65) Prior Publication Data

US 2008/0168998 A1 Jul. 17, 2008

(30) Foreign Application Priority Data

Feb. 1, 2005 (EP) ..... 05002044

(51) Int. Cl.
*B01J 20/284* (2006.01)

(52) U.S. Cl. ..... 131/344; 131/365

(58) Field of Classification Search ..... 131/344, 131/361

See application file for complete search history.

(56) References Cited

U.S. PATENT DOCUMENTS

| | | | |
|---|---|---|---|
| 4,637,410 | A | 1/1987 | Luke |
| 4,964,427 | A | 10/1990 | Case et al. |
| 5,056,537 | A | 10/1991 | Brown et al. |
| 5,058,608 | A | 10/1991 | Henning et al. |
| 6,502,582 | B1 | 1/2003 | Peters et al. |
| 2004/0182400 | A1 * | 9/2004 | Atobe et al. ..... 131/202 |

FOREIGN PATENT DOCUMENTS

| | | | |
|---|---|---|---|
| CN | 2260464 | Y | 8/1997 |
| CN | 2607035 | Y | 3/2004 |
| EP | 0908110 | | 4/1999 |
| EP | 0908110 | A1 | 4/1999 |
| JP | 61-280261 | | 12/1986 |
| JP | 11-17773 | | 5/1989 |
| JP | 11-103843 | | 4/1999 |
| JP | 11-124798 | | 5/1999 |
| JP | 2001-520874 | T | 11/2001 |
| JP | 2004-535158 | T | 11/2004 |
| WO | 99/21445 | | 5/1999 |
| WO | WO 02/69745 | A1 | 2/2002 |
| WO | 03/039274 | | 5/2003 |

OTHER PUBLICATIONS

International Search Report with Written Opinion dated Apr. 12, 2006, issued in PCT/EP2006/050486.

Clarke et al., "The Effect of Adsorbent Distribution on Vapour Phase Retention of Ventilated Filters", *World Tobacco*, Nov. 1992, pp. 55-58.

Import Tobacco Catalogue by Tokyo Tobacco Services Kabushiki Kaisha, Apr. 2002 (with attached English excerpt).

Tobacco Catalogue by JT Corporation, Jul. 2003 (with attached English excerpt).

* cited by examiner

*Primary Examiner*—Carlos Lopez
(74) *Attorney, Agent, or Firm*—Buchanan Ingersoll & Rooney PC

(57) ABSTRACT

A filter cigarette comprising a tobacco rod which is circumscribed by a cigarette paper and a filter, said filter comprising a tobacco-side filter element and a mouth-side filter element, said filter cigarette having a diameter of about 4 mm to about 7 mm, yielding a smoke yield of 1 mg condensate or less and yielding a nicotine yield of 0.2 mg or less. The filter cigarette is characterized in that the overall length of the filter is about 25 mm to about 40 mm, the length of the tobacco-side filter element is about 10 mm to about 25 mm and the tobacco-side filter element comprises a ventilation zone.

11 Claims, No Drawings

FILTER CIGARETTE

This application is a national stage application under 35 USC §371 of International Application Number PCT/EP2006/050486, filed Jan. 27, 2006, the international Application being published in English. This application also claims priority under 35 USC §119 to European Application No. 05002044.5, filed Feb. 1, 2005, the entire contents of each is hereby incorporated by reference.

The subject invention relates to a slim cigarette, in particular a cigarette with a diameter of from about 4 mm to about 7 mm.

Slim cigarettes are known in the art and commercially available. WO 99/21445 discloses a slim cigarette with a smoke yield of at most 1 mg condensate and a nicotine/condensate×10 strand yield ratio of ≧1.0. This slim cigarette comprises a tobacco rod which is attached to a filter with a (high retention) tobacco-side filter element and a (low retention) mouth-side filter element. The mouth-side filter element contains a ventilation zone which is spaced at least 1 mm from the tobacco-side filter element. Moreover, WO 99/21445 discloses an overall filter length of 25 to 30 mm with the length of the mouth-side filter element being between 13 to 18 mm.

The present invention provides a filter cigarette comprising a rod comprising a column of smokable material, such as a tobacco rod circumscribed by an air permeable wrapper, for example a cigarette paper, and a filter, said filter comprising a tobacco-side filter element and a mouth-side filter element, said filter cigarette having a diameter of from about 4 mm to about 7 mm, yielding (from the main stream smoke) a smoke yield of about 1 mg condensate (tar) or less, and yielding (from the main stream smoke) a nicotine yield of about 0.2 mg or less, characterized in that the total length of the filter is from about 25 mm to about 40 mm, whereas the tobacco-side filter element has a length of from about 10 mm to about 25 mm and in that the tobacco-side filter element comprises a ventilation zone.

As used herein, the tobacco-side filter element is the element of the filter which is located adjacent to and attached to the tobacco rod. The mouth-side filter element is the element of the filter which is located on the side of the filter opposite the tobacco rod and, thus, on the side of the filter which comes into contact with the smoker's mouth.

Preferably, the filter cigarette of the present invention has a diameter of from about 5 mm to about 6 mm.

Preferably, the filter cigarette of the present invention has a nicotine yield of about 0.1 mg or less.

Preferably, the overall length of the filter is from about 25 mm to about 35 mm.

Preferably, the tobacco-side filter element has a length of from about 15 mm to about 25 mm.

Surprisingly, the slim cigarette according to the subject invention allows relatively high packing or filling densities of above about 200 mg/cm$^3$. Furthermore, the cigarette of the present invention does not require the addition of expanded tobacco but, nevertheless, provides a low smoke yield of at most 1 mg condensate (in the mainstream smoke) and a nicotine yield (in the mainstream smoke) of at most 0.2 mg, preferably of at most 0.1 mg. However, if desired, relatively low amounts of expanded tobacco may be added. The amount of expanded tobacco in a cigarette of the present invention preferably is below about 20 percent of the total tobacco amount in the cigarette.

The degree of ventilation is, as a rule, above about 60 percent and preferably above 70 percent. In particular, the degree of ventilation is between about 70 percent and about 95 percent and most preferably between about 80 percent and about 85 percent.

It has been found that the slim cigarettes according to the subject invention may be made with a lower degree of ventilation, as compared to the slim cigarettes disclosed in WO 99/21445. Because of the lower degree of ventilation, the slim cigarettes according to the subject invention can be easily ignited and also provide the consumer with more taste per puff.

Any kind of conventional tobacco, preferably fine cut tobacco (such as Burley, Md., Flue Cured or Oriental tobaccos and mixtures thereof) can be used for making the slim cigarettes according to the subject invention. As discussed above, expanded tobacco can be added, however, preferably only in amounts of less than about 20 percent of the overall amount of tobacco, and even more preferably no expanded tobacco is added at all. The tobacco is then wrapped into an air permeable wrapper, such as conventional cigarette paper. For example, this may be done as known on commercial (high speed) cigarette makers on which the resulting endless tobacco rod is cut into the desired length and then attached to the filter. The conventional cigarette paper comprises cellulose, an inorganic filler and a burning additive, and has a porosity of about 10 Coresta units to about 100 Coresta units, preferably of about 20 Coresta units to about 60 Coresta units. Preferably, the resulting tobacco rod has a packing density of above about 200 mg/cm$^3$, in particular of above about 220 mg/cm$^3$ and most preferably of above about 240 mg/cm$^3$.

Any conventional filter materials known in the art may be used for the filter elements of the slim cigarettes according to the subject invention.

Preferably the mouth-side filter element is made from cellulose acetate.

Preferably, the tobacco-side filter element is made from paper, in particular crepe paper, high efficiency cellulose acetate fibers, a mix of cellulose and cellulose acetate, or other known materials having a high particle removal efficiency. The tobacco-side filter element may also include adsorbing materials such as activated carbon.

In one preferred embodiment the filter of the slim cigarettes according to the invention is comprised of only two filter elements, namely the mouth-side filter element and the tobacco-side filter element. In another preferred embodiment one or more, in particular, one additional filter element may be present. Thus, a middle filter element may be present which is located between the mouth-side filter element and the tobacco-side filter element. The middle filter element may be made of cellulose acetate, charcoal, cellulose or paper incorporating activated carbon. Preferably the middle filter element is made of cellulose acetate in which charcoal (or any other adsorbent material known in the art) is finely distributed. Alternatively the middle filter element may be a cavity which is filled with activated carbon or other adsorbent or absorbent material suitable for use in smoking articles. The preferred loading or carbon (or other adsorbent material) is between about 5 mg and about 50 mg.

In a further preferred embodiment the tobacco-side filter element or the middle filter element, or both elements may contain flavor release agents such as flavored cellulose thread, sepiolite, molecular sieves or activated carbon impregnated with flavors.

In the case of triple filters a ventilation zone may also be located on the middle filter element (in addition to the ventilation zone on the tobacco-side filter element).

The double, triple or multiple filters used in the slim cigarettes according to the invention can be prepared in conventional and well-known ways. Thus, each of the filter materials is processed on conventional (high speed) filter makers into endless filter rods which are then cut to the desired length. The resulting cut filter elements are then brought in the desired sequence and combined to each other by wrapping into conventional filter wrapping paper or plug wrap yielding preferably a filter rod which has twice the length (or multiples thereof) of the final filter and in which the mouth-side elements of the final filters are adjacent to each other. If desired, more than one layer of filter wrapping paper may be used. Thus, for a "double-length" filter, the sequence of filter elements within that filter rod may be: tobacco-side filter element, optionally middle filter element, mouth-side filter element, mouth-side filter element, optionally middle filter element, tobacco-side filter element. These filter rods are then attached on each side with the above-described tobacco rods using (high speed) cigarette makers in conventional ways. The attachment is achieved by wrapping the filter rod and the tobacco rod with conventional tipping paper such that the tipping paper covers the filter rod completely and overlaps to a small extent, for example about 5 mm, with the tobacco rod. Cutting the resulting product in the middle leads to the final slim cigarette according to the invention.

As mentioned above, the ventilation zone is located on the tobacco-side filter element. Consequently, the mouth-side filter element is not ventilated, that is it does not comprise a ventilation zone. This may be achieved by using for the mouth-side filter element a filter wrapping paper or a tipping paper which is substantially non-porous or air impermeable. Such paper has a porosity of 5 Coresta units or less.

The above-described ventilation zone of the tobacco-side filter element is preferably made by providing perforations on the tobacco-side filter element. These perforations may be achieved, for example, either by perforating the tipping paper before attaching the filter to the tobacco rod or by perforating the filter of the filter cigarette on-line. The ventilation zone and the holes resulting from perforation allow surrounding ambient air to enter into the filter and dilute the mainstream smoke when the smoker draws on the cigarette. According to the subject invention it is preferred that the tipping paper used for attaching the filter to the tobacco rod is laser perforated before it is wrapped around the filter element (so-called off-line laser perforation). These perforations are arranged in discrete zones in such a way that these zones are located on the tobacco-end filter element when joining the filter to the tobacco rod with said tipping paper. The filter element underneath the tipping paper with its ventilation holes needs to be wrapped in highly porous filter wrapping paper. Such a highly porous filter wrapping paper has a porosity of between about 8,000 Coresta units to about 50,000 Coresta units, preferably between about 12,000 Coresta units to about 30,000 Coresta units and may be made of cellulose. This highly porous filter wrapping paper can also be used for wrapping the mouth-side filter element, and optionally the middle filter element, provided that the tipping paper as such (without the laser perforations) is sufficiently non-porous.

The ventilation zone is preferably made of a circumferential ring around the tobacco-side filter element with a width of from about 2 mm to about 5 mm, preferably from about 3 mm to about 4 mm. This ring can be made of a plurality of single perforations forming one or more, for example two, three, four, six, or eight separate lines of perforations. Preferably the first row of the ventilation zone is at least about 1 mm away from the adjacent filter element (typically the mouth-side filter element or the middle filter element). This gap of at least about 1 mm avoids that minor irregularities during the manufacturing process of the filter could lead to the ventilation zone being located not exclusively on the tobacco-side filter element but partially on the tobacco-side filter element and the adjacent filter element.

Preferably the center of the ventilation zone is located about 5 mm to about 15 mm, preferably about 7 mm to about 13 mm, in particular about 11 mm within the tobacco-side filter element and downstream from the contact area between the tobacco rod and the tobacco-side filter element.

As described above, the length of the overall filter (comprised of two, three or more filter elements) is about 25 mm to about 40 mm, preferably about 25 mm to about 35 mm and in particular about 26 mm to about 29 mm. An overall length of about 25 mm to about 40 mm is preferred for triple or multiple filters. A length of about 25 mm to about 35 mm is preferred for double filters.

The length of the tobacco-side filter element is about 10 mm to about 25 mm, preferably about 15 mm to about 25 mm and in particular about 15 mm to about 20 mm.

The length of the mouth-side filter element is preferably about 10 mm to about 15 mm and in particular about 11 mm to about 13 mm.

The length of the middle filter element is preferably about 5 mm to about 15 mm, in particular about 5 mm to about 10 mm and most preferably about 6 mm to about 9 mm.

The following two embodiments exemplify the subject invention and are not to be construed as a limitation thereof.

In the first embodiment the cigarette has a diameter of 5.4 mm and an overall length of 97 mm. The overall length of the filter is 27 mm.

The tobacco-side filter element has a length of 16 mm and is made of crepe paper with a resistance to draw of about 90 to about 120, preferably of about 105 mm/WG (water gauge). It is surrounded by a highly porous filter wrapping paper with a porosity of about 24,000 Coresta units.

The mouth-side filter element is located adjacent to and attached to the tobacco-side filter element. The mouth-side filter element has a length of 11 mm and is made of cellulose acetate with a resistance to draw of about 40 to about 55, preferably of about 50 mm/WG. It is surrounded by low-porous or non-porous filter wrapping paper with a porosity of less than 6,000 Coresta units. Both filter elements are joined (wrapped) together with a highly porous wrapping paper with a porosity of about 24,000 Coresta units.

The filter is attached to the tobacco rod by way of tipping paper which has a length of about 32 mm. Since it covers the filter completely, it overlaps with the tobacco rod by about 5 mm. The ventilation zone in the tobacco-side filter element is made of six parallel perforation lines which are made off-line by laser perforation. The width of the ventilation zone is 4 mm and its location is 9 to 13 mm downstream from the contact area between the tobacco-side filter element and the tobacco column. The ventilation zone provides a ventilation of about 80 to 85 percent, preferably of about 82 percent. The total filter resistance to draw is about 130 to about 210 mm/WG, in particular about 160 mm/WG. The cigarette resistance to draw is about 100 to about 140 mm/WG, in particular about 120 mm/WG. The diameter of the filter itself is about 5.2 mm and slightly smaller than the final diameter of about 5.4 mm of the slim cigarette. This difference results from the filter wrapping paper and the tipping paper.

The second embodiment corresponds to the first embodiment, however, an additional middle filter element with a length of 7 mm and made of cellulose acetate with charcoal incorporated and finely dispersed therein. Thus, a slim cigarette with a triple filter and an overall length of 104 mm and a filter length of 34 mm results.

The tobacco used in both cigarettes is American Blend type with a packing density of 250 mg/cm$^3$.

For both embodiments the puff number is 6 to 7, the mainstream smoke yield is 1 mg condensate (tar) and 0.1 mg nicotine resulting in a nicotine/condensate ratio of 0.1 (or a nicotine/condensate×10 ratio of 1.0).

The invention claimed is:

1. Filter cigarette comprising a tobacco rod which is circumscribed by a porous wrapper, and a filter, said filter comprising a tobacco-side filter element and a mouth-side filter element, said filter cigarette having a diameter of about 4 mm to about 7 mm, the tobacco rod has a packing density of above about 240 mg/cm$^3$, yielding a smoke yield of about 1 mg condensate or less, yielding a nicotine yield of about 0.2 mg or less, the overall length of the filter is about 25 mm to about 40 mm, the length of the tobacco-side filter element is about 10 mm to about 25 mm and the tobacco-side filter element comprises a ventilation zone.

2. Filter cigarette according to claim 1, wherein the mouth-side filter element and the tobacco-side filter element are both surrounded by at least one filter wrapping paper followed by a tipping paper and in that the ventilation zone of the tobacco-side filter element is made by perforations in the tobacco-side filter element tipping paper and in that a porous tobacco-side filter element filter wrapping paper or porous tobacco-side filter element filter wrapping papers is/are provided.

3. Filter cigarette according to claim 1, wherein the degree of ventilation is between about 70% and about 95%.

4. Filter cigarette according to claim 2 wherein the perforations in the tobacco-side filter element are a plurality of perforations forming a circumferential ring around the tobacco-side filter element with a width of about 2 mm to about 5 mm.

5. Filter cigarette according to claim 2 wherein the perforations are made by off-line laser perforations.

6. Filter cigarette according to claim 1 wherein the tobacco used has an expanded tobacco content of below about 20%.

7. Filter cigarette according to claim 1 wherein the porous wrapper is cigarette paper.

8. Filter cigarette according to claim 1 wherein the degree of ventilation is between about 80% and about 85%.

9. Filter cigarette according to claim 2 wherein the perforations in the tobacco-side filter element are a plurality of perforations forming a circumferential ring around the tobacco-side filter element with a width of about 3 mm to about 4 mm.

10. Filter cigarette according to claim 1 wherein the tobacco used has an expanded tobacco content of about 0%.

11. Filter cigarette according to claim 1 wherein the mouth-side filter element is not ventilated.

* * * * *